US006595550B1

(12) United States Patent
Meazzi

(10) Patent No.: US 6,595,550 B1
(45) Date of Patent: Jul. 22, 2003

(54) GUARANTEE SEAL FOR FOOD PRODUCTS AND A MACHINE FOR ITS AUTOMATIC APPLICATION TO THE PRODUCT

(75) Inventor: Alberto Meazzi, Montagnola (CH)

(73) Assignee: Renio - Comercio E Consultadoria LDA, Se Funchal ( * ) Notice: Subject to any disclaimer, the term of this patent is extended or adjusted under 35 U.S.C. 154(b) by 0 days.

(21) Appl. No.: 09/315,610

(22) Filed: May 20, 1999

(30) Foreign Application Priority Data

May 21, 1998 (PT) ..... 102157

(51) Int. Cl.[7] ..... B42D 15/00
(52) U.S. Cl. ..... 283/79; 283/81; 40/299
(58) Field of Search ..... 283/79, 80, 81, 283/101, 105, 56, 117, 74; 40/299, 633, 636, 637; 383/78

(56) References Cited

U.S. PATENT DOCUMENTS 3,228,129 A * 1/1966 Gwinn et al. ..... 283/80 X
4,112,603 A * 9/1978 Giulie ..... 283/79 X
5,366,249 A * 11/1994 Diemert ..... 283/80
5,560,657 A * 10/1996 Morgan ..... 283/80

* cited by examiner

*Primary Examiner*—Willmon Fridie, Jr.
(74) *Attorney, Agent, or Firm*—McGlew and Tuttle, P.C.

(57) ABSTRACT

The invention refers to a seal of guarantee (10) for foodstuff wrapped in a packaging, which closes said packaging and which has the shape of a label, having a tab (11) which can be folded down on to itself to cover a sufficient portion of the packaging, with a zone (12) where it is possible to write information regarding the product, such as the production and best before dates. The invention also refers to a machine to automatically apply the seal (10) which fundamentally includes a loader (17) containing a pile of seals, which are picked up one at a time from the underside, a cursor (19) which handles the seals to be applied, a tool (21) to fold the tab (11) and a seal applicator head (18) for ultrasonic welding, gluing or similar.

19 Claims, 2 Drawing Sheets

GUARANTEE SEAL FOR FOOD PRODUCTS AND A MACHINE FOR ITS AUTOMATIC APPLICATION TO THE PRODUCT

FIELD OF THE INVENTION

This invention regards a new guarantee seal for food products and a machine for applying this seal to the packaged product.

BACKGROUND OF THE INVENTION

In the field of packaging and distribution of food products, a seal represents an inviolable means of closing a container, bag or similar with a guarantee of integrity for the product contained inside and/or a way of identifying the product which is being distributed.

At present, to close and seal bags used as wrappings for food products, metal or plastic clips are applied automatically by machine or adhesive tape is applied, either by hand or mechanically.

For string-bound products, such as salami, with its string or net container, the seal may be: a leaden seal; a pre-stamped aluminium clip; a plastic or paper label applied by hand; a round aluminium clip applied by machine.

However, these well-known systems for closing and sealing food products are not all applicable by automatic means, nor are they easily visible, and they have little surface area or anywhere to carry information about the origin, ingredients, date of packaging or expiry date etc. of the product. There is also a difference between those used for wrapping bags and those used for sausage meats.

SUMMARY AND OBJECTS OF THE INVENTION

Meanwhile, the aim of this invention is to supply a guarantee seal that can be used for closing food products with bag wrapping as well as identifying string-bound products, that can be easily applied by an automatic machine, that can carry and display various types of printed information, and, therefore, overcome the limitations in application and use of the closing devices and seals used to date.

This aim is achieved by the invention of a guarantee seal in the form of a plaque or label with a stem that can be folded and fastened around a bag or wrapper to seal it, and an explanatory part intended to carry various types of information about the product on either side.

This invention also proposes a machine for the automatic application of said guarantee seal to the wrappers or products to be sealed. The machine consists of a loader for numerous stacked seals, a slider for taking the seals one at a time from the base of the loader to the application head, where there is a device for folding the stem of the seal around the product bag or wrapper, a means for fastening the folded stem and an element for printing at least the essential information on either part of the seal.

More details about the invention will become clear in the following description, which refers to the enclosed diagrams, which are indicative but not restrictive, and where:

DESCRIPTION OF THE PREFERRED EMBODIMENT

Figure 1:
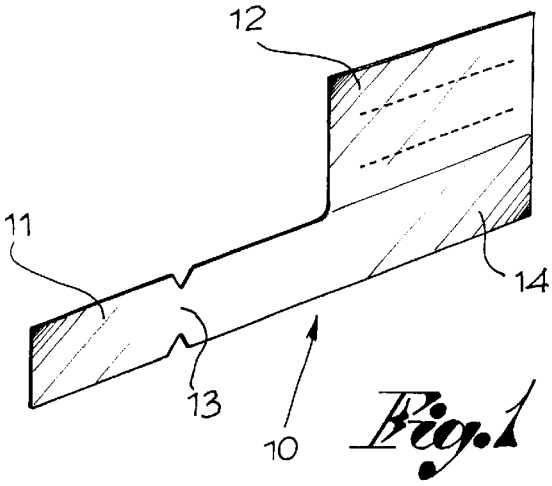
FIG. 1 shows an open seal, before use.

This seal has the shape of a label or plaque 10 made from plastic material as used in the food industry. It consists of a stem 11 joined to an explanatory part 12. The size and surface area ratio between the stem 11 and the explanatory portion can vary according to need. The stem can also be folded in two, where the indentation 13 facilitates this.

On both sides of the explanatory part 12, information can be printed, or written in food ink, about the producer, product ingredients and/or any other legal requirement, leaving a space or panel 14, as necessary, for other data or information to be added later.

Figure 2:
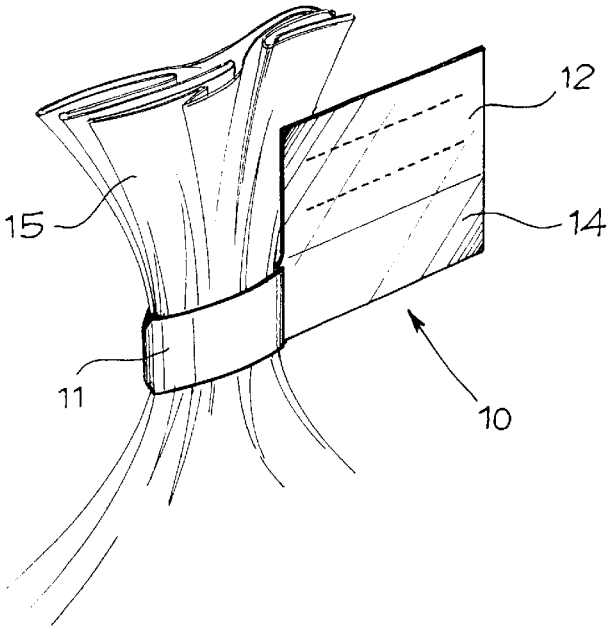
FIG. 2 shows the label when it is applied to a closed bag.
Figure 3:
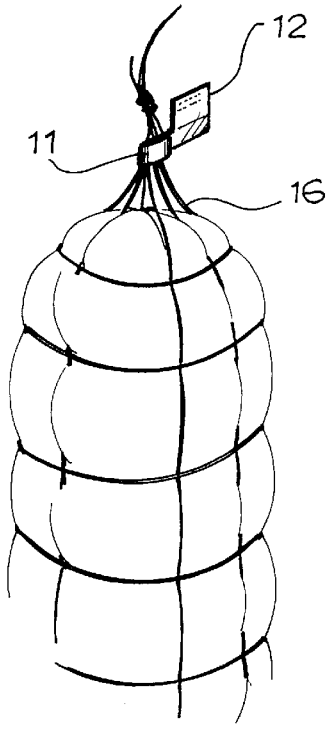
FIG. 3 shows the label when it is applied to a string-bound product.

The practical application of the above seal requires folding and fastening the stem 11 around the opening of a bag 15, or part of the string or net wrapping 16 of a product which needs to have its integrity guaranteed. Wrappings with the seal applied are shown as examples in FIGS. 2 and 3. The stem may be fastened by means of welding, ultrasonic soldering or similar, or using glue. Meanwhile, the explanatory portion remains free, with both sides exposed so as to reveal the printed information.

When the stem is folded and fastened to the wrapper 15 or 16, in the space or panel 14 additional information, the package date and/or the product expiry date can be printed.

This seal is innovative in design and use for the following reasons:

it represents an inviolable closure and guarantee of product integrity, whatever the shape of the packaging;

it is suitable for carrying various types of printed information, which can be added even at the moment of fastening;

it is made from plastic for food products and can be printed with food ink or stamped;

it is a useful device for carrying all the information foreseen by the law; and it represents a publicity vehicle for the product producer or distributor.

Figure 5:
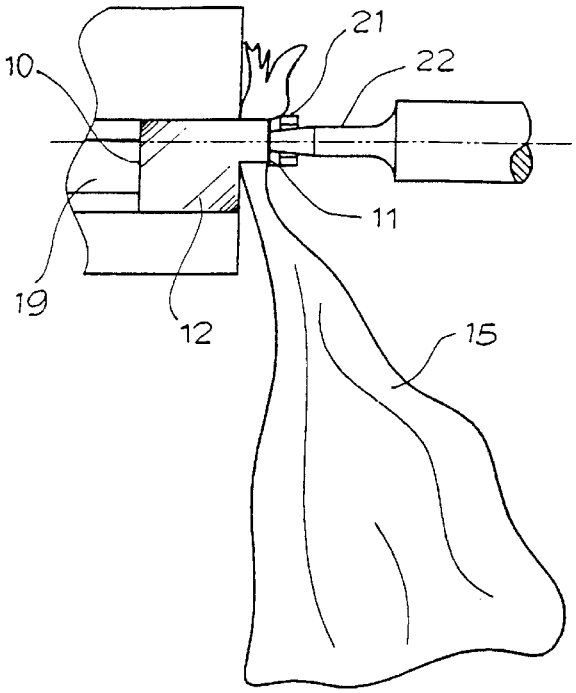
FIG. 5 shows a detail of the machine during the phase of closing the seal around the bag.
Figure 4:
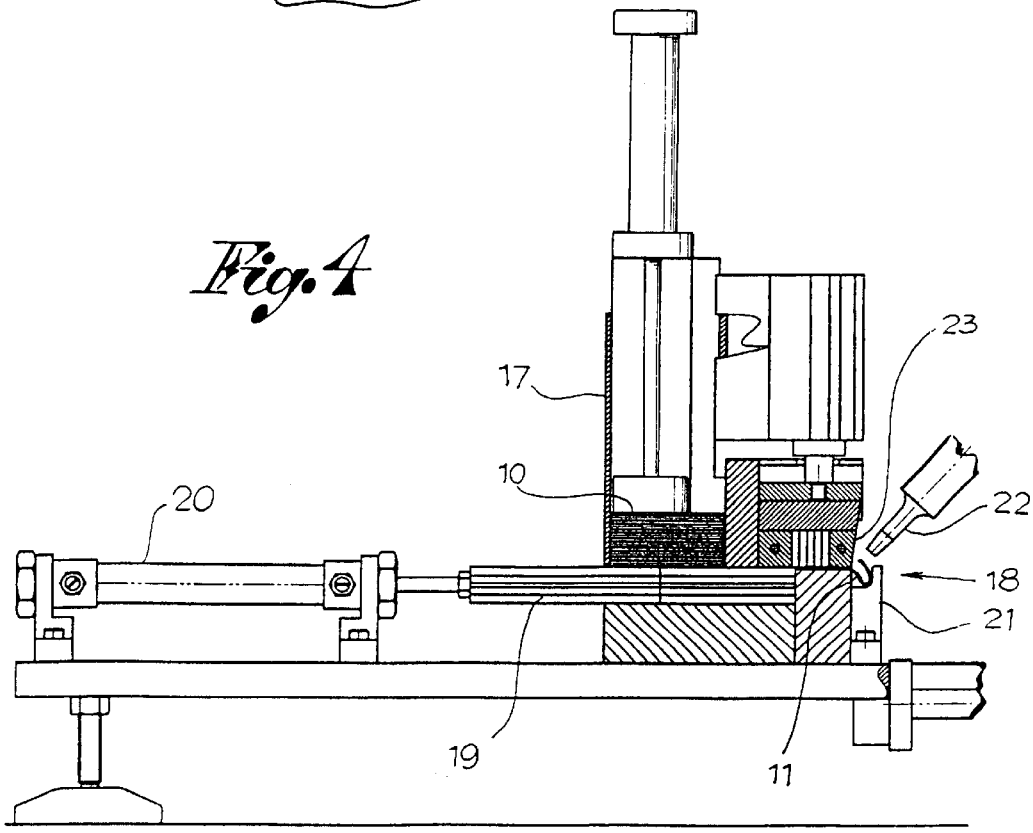
FIG. 4 shows a diagram of a machine for applying the seal in FIG. 1.

This invention also includes a machine for the physical application of the guarantee seal to a product bag or wrapper, and consists of—FIGS. 4 and 5—a loader 17, which contains a stack of seals 10 and a head 18 for the application and fastening of each seal 10 to a wrapper 15 or net bag 16 as a guarantee of the product inside. Between the loader 17 and the application head 18, the machine has a slider or shuttle 19 which can be moved by an alternating device 20 from a backward position to a forward one. The slider or shuttle 19 is designed to take one seal at a time from the base of the loader 17 and transport it to the head 18 with a back and forth movement.

The application head consists of: a device 21 for folding around a wrapper or bag 15 or 16 the stem 11 of the seal, which is pushed forward from the loader by the slider or shuttle 19; a means 22 of fastening the folded stem around the package to be sealed and an element 23 for printing the essential information, such as the date of packaging and/or date of expiry on the explanatory part 12 of the seal.

Furthermore, the machine may have a different structure or layout from the one illustrated, but without changing the principles of the invention.

While specific embodiments of the invention have been shown and described in detail to illustrate the application of the principles of the invention, it will be understood that the invention may be embodied otherwise without departing from such principles.

What is claimed is:

1. A guarantee seal for food products closed in a bag, the seal comprising: a plaque or label element with a stem portion having a fold between a first stem portion and a second stem portion with the stem portion folded around the bag and fastened around the bag and with an explanatory portion carrying printed information about the product on both sides, said explanatory portion and said stem portion being formed integral of plastic material, said first stem portion and said second stem portion being welded together with plastic material of said first stem portion and plastic material of said second stem portion forming a weld connection to seal food in the bag.

2. The guarantee seal according to claim 1, wherein said stem portion includes an indentation between said first stem portion and said second stem portion wherein said indentation facilitates folding the stem portion around the bag.

3. The guarantee seal according to claim 1 wherein the stem portion, once folded, is welded by ultrasonic welding.

4. The guarantee seal according to claim 1 wherein the explanatory portion has a space or panel for printing additional information at the moment of applying the seal to the bag.

5. The guarantee seal according to claim 1, wherein the plastic material is a plastic material for the food industry.

6. The guarantee seal according to claim 2 wherein the stem is first folded and then welded by means of ultrasonic welding.

7. The guarantee seal according to claim 2, wherein the explanatory portion has a space or panel for printing additional information at the moment of applying the seal to the bag.

8. The guarantee seal according to claim 3, wherein the explanatory portion has a space or panel for printing additional information at the moment of applying the seal to the bag.

9. The guarantee seal according to claim 2, wherein the plastic material is in plastic material for the food industry.

10. The guarantee seal according to claim 3, wherein the plastic material is in plastic material for the food industry.

11. The guarantee seal according to claim 4, wherein the plastic material is in plastic material for the food industry.

12. A seal for food closed in an enclosing structure, the seal comprising:

an indicia portion having a surface area for displaying printed information;

a stem portion extending from said indicia portion and formed integral with said indicia portion and having a length wrapped around a neck of the enclosing structure, first and second portions of said length being formed of a food industry plastic which is welded together to form a plastic to plastic weld, said length of said stem portion and a position of said weld fastening said stem portion around the neck and sealing the food in the enclosing structure.

13. A seal in accordance with claim 12, wherein:

said first and second portions are spaced at a distance from each other to cause said weld to close the neck of the enclosing structure and form a seal between the inside and outside of the enclosing structure.

14. A seal in accordance with claim 12, wherein:

a size and material of the stem portion is formed to have sufficient strength to close the neck of the enclosing structure and seal the food inside the enclosing structure.

15. A seal in accordance with claim 12, wherein:

said indicia portion has a width that is larger than a width of said stem portion.

16. A seal in accordance with claim 12, wherein:

a food industry ink is adhered to said food industry plastic and forms indicia on said indicia portion.

17. A seal in accordance with claim 12, wherein:

said stem portion includes an indentation with a width narrower than a width of adjacent parts of said stem portion for folding of said stem portion at said indentation.

18. A seal in accordance with claim 13, wherein:

a size and material of the stem portion is formed to have sufficient strength to close the neck of the enclosing structure and seal the food inside the enclosing structure;

said indicia portion has a width that is larger than a width of said stem portion;

a food industry ink is adhered to said food industry plastic and forms indicia on said indicia portion;

said stem portion includes an indentation with a width narrower than a width of adjacent parts of said stem portions for folding of said stem portion at said indentation.

19. A seal arrangement for food, the seal arrangement comprising:

an enclosing structure surrounding the food and having a neck at one end of the food;

an indicia portion having a surface area for displaying printed information;

a stem portion extending from said indicia portion and having a length wrapped around said neck of said enclosing structure, first and second portions of said length being formed of a food industry plastic which is welded together to form a weld, said length of said stem portion and said weld fastening said stem portion around said neck and sealing the food in said enclosing structure.

* * * * *